US008690294B2

(12) United States Patent
Ito

(10) Patent No.: US 8,690,294 B2
(45) Date of Patent: Apr. 8, 2014

(54) METHOD FOR MANUFACTURING NOZZLE PLATE

(75) Inventor: Masaharu Ito, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 997 days.

(21) Appl. No.: 12/269,291

(22) Filed: Nov. 12, 2008

(65) Prior Publication Data

US 2009/0122111 A1 May 14, 2009

(30) Foreign Application Priority Data

Nov. 14, 2007 (JP) ..... 2007-295065

(51) Int. Cl.
*B41J 2/14* (2006.01)
*B41J 2/16* (2006.01)
*B41J 2/135* (2006.01)

(52) U.S. Cl.
USPC ..... 347/45; 347/44; 347/47

(58) Field of Classification Search
USPC ..... 347/44, 45, 47
See application file for complete search history.

(56) References Cited

U.S. PATENT DOCUMENTS

| | | | | |
|---|---|---|---|---|
| 6,302,523 | B1 * | 10/2001 | Smith et al. | 347/45 |
| 2006/0262162 | A1 * | 11/2006 | Sugahara | 347/54 |
| 2008/0198199 | A1 | 8/2008 | Murata | |

FOREIGN PATENT DOCUMENTS

| | | |
|---|---|---|
| JP | S62-144638 | 9/1987 |
| JP | 3010728 | 12/1999 |
| JP | 2002-127424 | 8/2002 |
| JP | 3719005 | 9/2005 |
| JP | 2006-205679 | 8/2006 |
| JP | 2007-050661 | 3/2007 |

OTHER PUBLICATIONS

Fukunaga et al., Machine-Translation of Japanese Patent Publication JP-200750661, Mar. 1, 2007.*

* cited by examiner

*Primary Examiner* — Ryan Lepisto
*Assistant Examiner* — Erin Chiem
(74) *Attorney, Agent, or Firm* — Frommer Lawrence & Haug LLP

(57) ABSTRACT

A method for manufacturing a nozzle plate includes providing a substrate having a nozzle surface in which a plurality of nozzle holes jetting a liquid is formed, and on which a water repellent film is formed, placing a plurality of droplets of a liquid resin around each of the nozzle holes, and curing the liquid droplets to form projections of a constant height around the nozzle holes. By placing the plurality of droplets of the liquid resin to surrounding area of each of the nozzle holes, and curing the droplets, it is possible to form the projections which prevent a recording medium from making contact with the nozzle surface.

5 Claims, 9 Drawing Sheets

METHOD FOR MANUFACTURING NOZZLE PLATE

CROSS REFERENCE TO RELATED APPLICATION

The present application claims priority from Japanese Patent Application No. 2007-295065, filed on Nov. 14, 2007, the disclosure of which is incorporated herein by reference in its entirety.

BACKGROUND OF THE INVENTION

1. Field of the Invention

The present invention relates to a method for manufacturing a nozzle plate.

2. Description of the Related Art

An ink-jet recording apparatus which records on a recording medium by jetting an ink from nozzle holes of an ink-jet head has hitherto been known. A common example of such ink-jet head includes a nozzle plate, in which a plurality of nozzle holes for jetting an ink is formed, on a lower side, and a water repellent film, which avoids adhering of the ink to a nozzle surface, is formed on a nozzle surface which is the lower surface of the nozzle plate.

Since the nozzle surface faces the recording medium, sometimes, the recording paper makes a contact with the nozzle surface due to a jamming of the recording paper, and the nozzle surface or the water repellent film formed on the nozzle surface is damaged. When the nozzle surface or the water repellent film near the nozzle holes is damaged, a jetting direction of the ink is inclined, and ink droplets are not formed as predetermined, thereby making it impossible to carry out normal jetting.

Moreover, in an ink-jet head described in Japanese Patent Application Laid-open No. 2002-127424, projections are formed near nozzle holes (ink jetting holes). These projections are provided near the ink jetting holes at an upstream side of a transporting direction of the recording paper with respect to each of the ink jetting holes, in order to avoid the jetting direction of the ink droplets being inclined due to an air flow generated between the nozzle surface and the recording paper, and to make the ink droplets land accurately at a predetermined position on the recording paper.

A nozzle member used in an ink-jet head described in Japanese Patent Application Laid-open No. 2002-127424 is manufactured as follows. Firstly, a metallic pattern corresponding to ink channels is formed on an upper surface of a substrate, and this metallic pattern is covered by a polyimide resin. Next, ink jetting holes are drilled by a laser machining. The metallic pattern which is formed is removed by melting by introducing (charging) an etchant through the ink jetting holes, and a cavity is formed at an inner side of the polyimide resin. Further, at the time of forming the polyimide resin, projections are formed simultaneously on an outer surface of the nozzle. Therefore, a die is necessary for forming the projections.

Besides, since such projections are not provided at a downstream side of the transporting direction of the recording paper, of each ink jetting hole, there is a possibility that the recording paper makes a contact with the nozzle surface due to jamming of the paper, and the water repellent film is damaged.

SUMMARY OF THE INVENTION

The present invention provides a method for manufacturing nozzle plate in which, projections for avoiding a contact with the recording medium can be formed easily around the nozzle holes.

According to a first aspect of the present invention, there is provided a method for manufacturing a nozzle plate, including: providing a substrate having a nozzle surface in which a plurality of nozzle holes jetting a liquid is formed, and on which a water repellent film is formed; placing a plurality of droplets of a liquid resin around each of the nozzle holes; and curing the liquid droplets to form projections of a constant height around the nozzle holes.

According to the first aspect of the present invention, by placing the droplets of a liquid resin around each of the nozzle holes, and curing the droplets, it is possible to form easily the projections for preventing a recording medium from contacting with nozzle surface.

In the method for manufacturing the nozzle plate of the present invention, a hollow suction cap may be detachably connected to the nozzle surface of the substrate to cover the nozzle holes, and the projections may be formed on the nozzle plate at a portion different from a portion to which the suction cap is connected. In this case, it is possible to protect the water repellent film around the nozzle holes by the projections. Moreover, since the projections are formed on the nozzle plate at a portion different from a portion to which the cap is connected, the connection of the suction cap at the time of purge is not hindered, and a close contact of the suction cap is not affected.

In the method for manufacturing the nozzle plate of the present invention, the projections may be provided between the nozzle holes, and the projections and the nozzle holes may be formed orderly in a predetermined direction and a direction orthogonal to the predetermined direction. In this case, since the projections and the nozzle holes are formed orderly, the recording medium is prevented from contacting with the nozzle surface at any portions of the nozzle surface.

In the method for manufacturing the nozzle plate of the present invention, the liquid droplets may be placed by jetting the liquid resin in a form of liquid droplets to print the liquid droplets on the nozzle surface. In this case, since the liquid resin is printed on the nozzle surface by jetting in the form of droplets, it is possible to place easily the liquid droplets of the liquid resin which are to be the projections on the nozzle surface.

In the method for manufacturing the nozzle plate of the present invention, the liquid resin may be an ultraviolet-curable resin, and may be cured by irradiation of ultraviolet ray. In this case, by using a peculiarity of the ultraviolet-cured resin, it is possible to cure the liquid resin easily.

According to a second aspect of the present invention, there is provided a method for manufacturing a nozzle plate including: providing a substrate having a nozzle surface in which a plurality of nozzle holes jetting a liquid is formed, and on which a water repellent film is formed; exfoliating the water repellent film from the nozzle surface at a plurality of portions around each of the nozzle holes; placing a plurality of droplets of a liquid resin on the portions at which the water repellent film is exfoliated; and curing the liquid droplets to form projections of a constant height around the nozzle holes.

According to the second aspect of the present invention, it is possible to form easily and assuredly the projections around each of the nozzle holes for preventing the recording medium from contacting with the nozzle surface without being affected by the water repellent film.

According to a third aspect of the present invention, there is provided a method for manufacturing a nozzle plate including: providing a substrate having a nozzle surface in which a plurality of nozzle holes jetting a liquid is formed; placing a plurality of droplets of a liquid resin around each of the nozzle holes; curing the liquid droplets to form projections of a constant height around the nozzle holes; and forming a water repellent film on the nozzle surface on which the projections are formed.

According to the third aspect of the present invention, it is possible to form easily and assuredly the projections around each of the nozzle holes for preventing the recording medium from contacting the nozzle surface without being affected by the water repellent film. Moreover, since the water repellent film is formed also on surfaces of the projections, it is possible to prevent the liquid from being adhered to the projections.

DETAILED DESCRIPTION OF THE PREFERRED EMBODIMENTS

Figure 1:
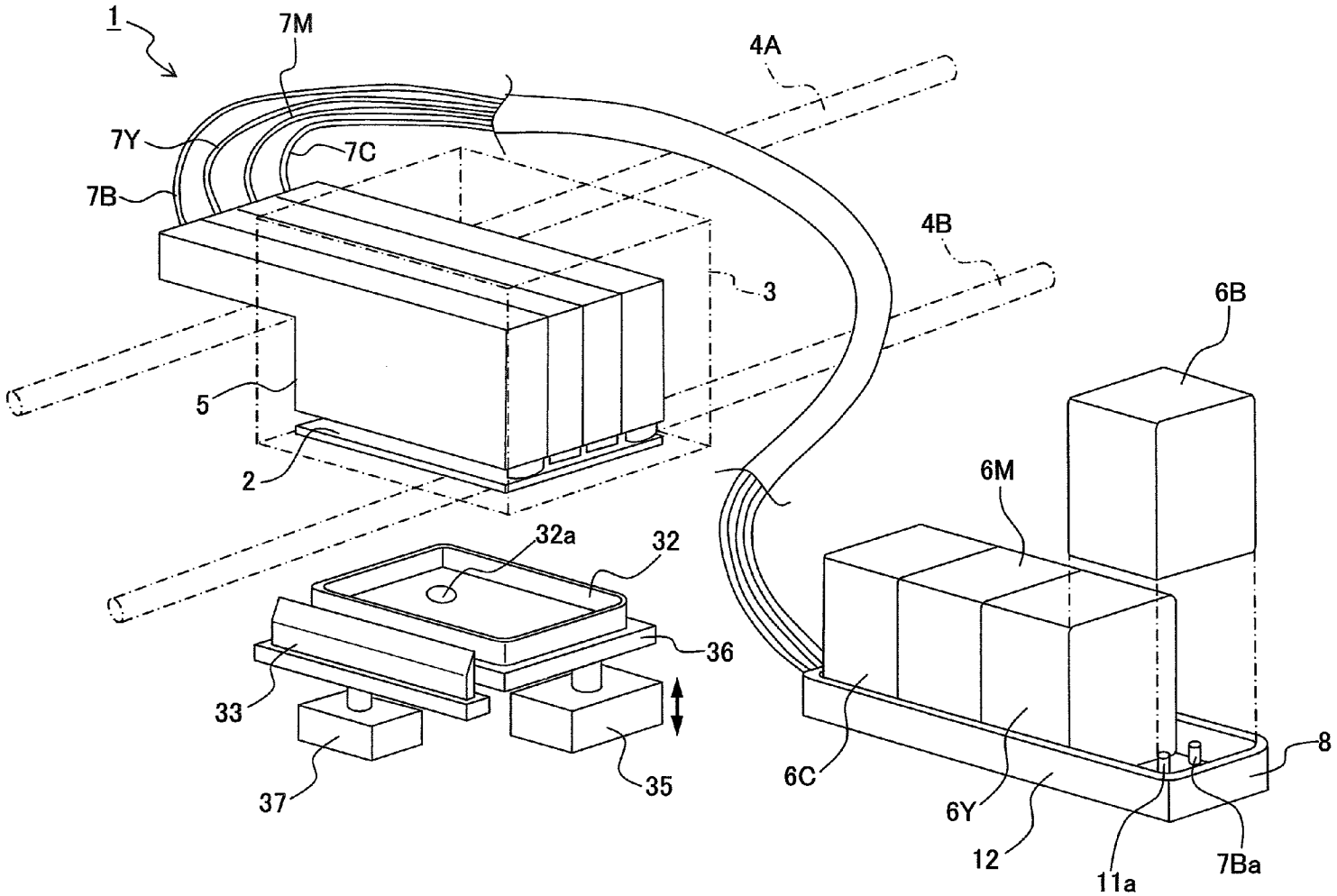
FIG. 1 is a perspective view showing an overall structure of an ink-jet recording apparatus according to an embodiment of the present invention.

An embodiment of the present invention will be described below by referring to the accompanying diagrams. In the following description, suffixes B, Y, M, and C assigned to each reference numeral are for inks of black, yellow, magenta, and cyan color respectively.

Figures 2A, 2B:
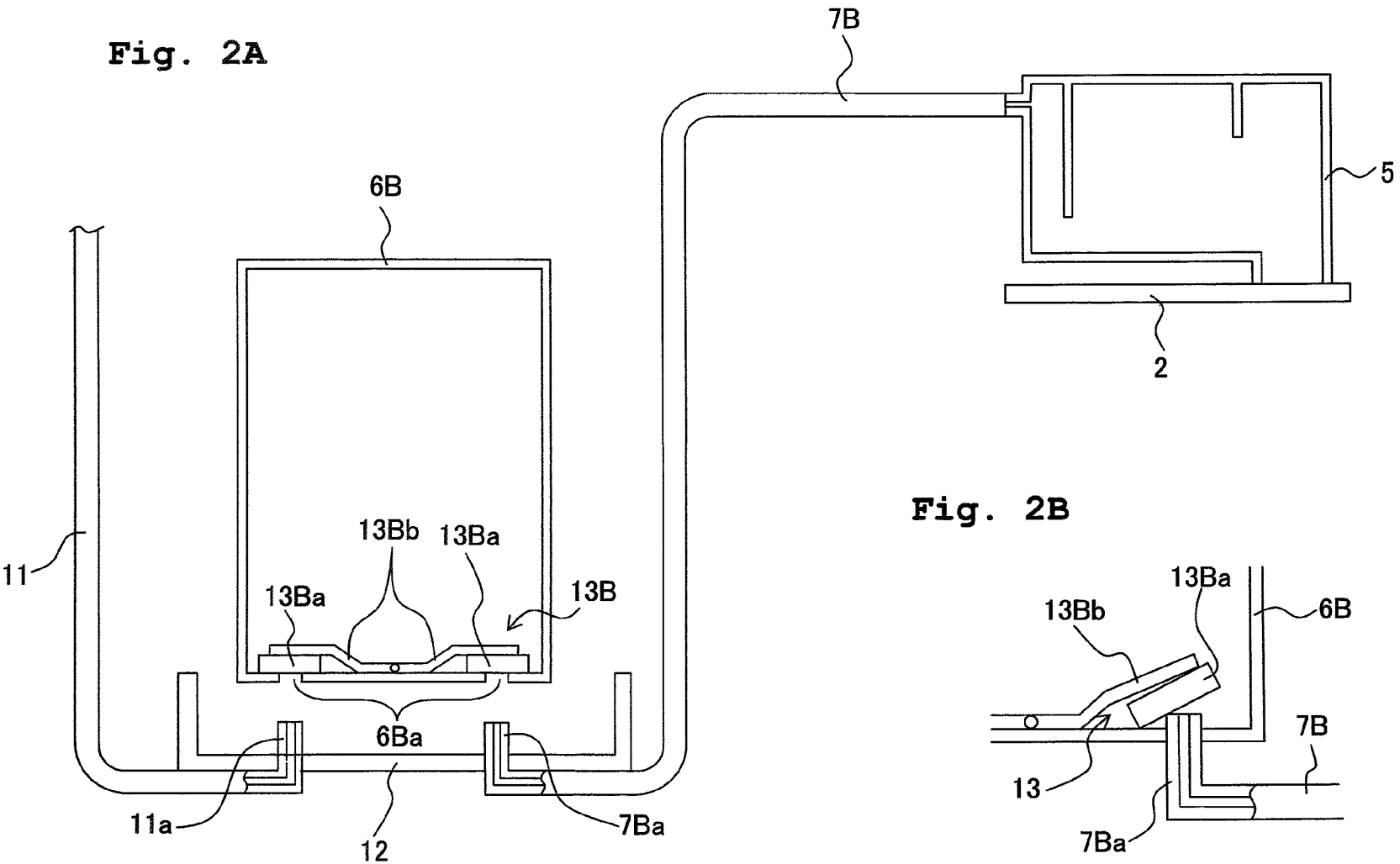
FIG. 2A is a diagram showing a positional relation between an ink tank and an ink cartridge.
FIG. 2B is a diagram showing a connecting state of the ink cartridge and an ink supply tube.

FIG. 1 is a perspective view showing an overall structure of an ink-jet recording apparatus according to the present invention, FIG. 2A is a diagram showing a positional relationship between an ink tank and an ink cartridge, and FIG. 2B is a diagram showing a connecting state of the ink cartridge and an ink supply tube.

As shown in FIG. 1 and FIG. 2A, an ink-jet recording apparatus 1 includes an ink-jet head 2. The ink-jet head 2 is held by a head holder 3 which relatively moves with respect to a recording paper (not shown in the diagram) as a recording medium. The ink-jet head 2 has nozzle groups which jet inks of plurality of types. The head holder 3 reciprocates along guide rails 4A and 4B extending in a direction orthogonal to a feeding direction of the recording paper by a drive mechanism which is not shown in the diagram. An ink tank 5 which supplies an ink to the ink-jet head 2 is mounted on the head holder 3.

Figure 3:
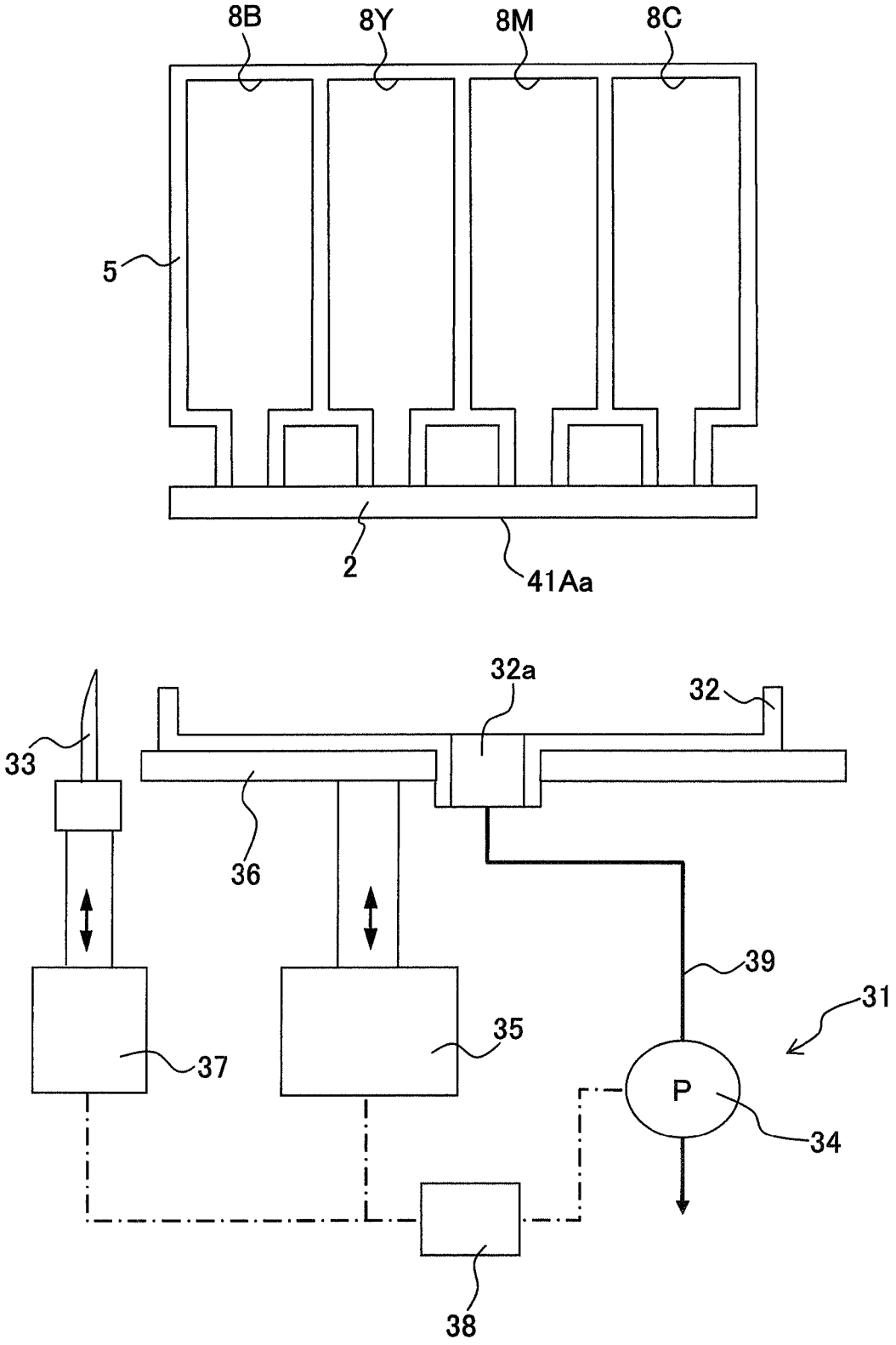
FIG. 3 is a diagram showing a positional relationship between an ink-jet head and a suction mechanism.

The ink tank 5 has ink storage chambers 8B, 8Y, 8M, and 8C (8B to 8C) which store plurality of types of inks respectively (refer to FIG. 3). Inks are supplied to the ink storage chambers 8B to 8C from ink cartridges 6B, 6Y, 6M, and 6C arranged outside the head holder 3, through ink supply tubes 7B, 7Y, 7M, and 7C (7B to 7C).

For instance, an upstream end of each of the ink supply tube 7B is formed to be cylindrical shaped as a connecting portion 7Ba as shown in FIG. 2A and FIG. 2B. The connecting portion 7Ba is installed at a predetermined position of a bottom portion of a cartridge tray 12 having a plate shape, such that a central axis line of the connecting portion 7Ba extends in vertical direction. Moreover, as shown in FIG. 1, parallel to the connecting portion 7Ba, a connecting portion 11*a* of an atmosphere communicating tube 11 is fixed to a bottom portion of the cartridge tray 12. The ink cartridge 6B is detachably connected by making the ink cartridge 6B descend toward the cartridge tray 12, and the ink supply to the ink storage chamber 8B of the ink tank 5 becomes possible. In other words, an opening 6Ba to which the connecting portions 7Ba and 11*a* are detachably connected is formed in the bottom portion of the ink cartridge 6B, and an opening and closing valve 13B, which is opened by connection of the ink cartridge 6B to the cartridge tray 12, is provided to the opening 7Ba. The opening and closing valve 13B includes a valve body 13Ba which openably closes the openings 6Ba and a plate spring 13Bb (common for two valve bodies 13Ba) which applies a bias to the valve body 13Ba in a direction of closing the opening 6Ba. When the ink is supplied from the ink cartridge 6B to the ink supply tube 7B, an atmosphere is infused into the ink cartridge 6B from the atmosphere communicating tube 11, and an inside of the ink cartridge 6B is maintained almost at an atmospheric pressure. A bias is applied on the two valve bodies 13Ba by one plate springs 13Bb. However, plate springs 13Bb may be provided respectively.

Moreover, as shown in FIG. 1 and FIG. 3, a recovery mechanism 31 is provided to face a lower surface of the head holder 3, in a movement path of the head holder 3, at a predetermined waiting position which is not involved in recording on the recording paper. The recovery mechanism 31 carries out a purge process of sucking thickened ink and air inside the ink-jet head 2, and discharging the ink and air to outside, in order to recover an ink jetting function, and carries out a wiping process of removing by wiping the ink adhered to a nozzle surface 41Aa which will be described later. As a unit carrying out the purge process, a suction cap 32 which is detachably connected to the nozzle surface 41Aa is provided as it has been known. A connection opening portion 32*a* of the suction cap 32 is connected to a suction pump 34 via a suction passage 39. The suction cap 32 is installed on a movable plate 36 which is supported to move up and down by a lift unit 35.

As a unit to carry out the wiping process, as it has been known, a wiper 33 made of an elastic blade of a material such as rubber is provided, and makes an approachable contact with the nozzle surface 41Aa. The wiper 33 is moved up and down by a lift unit 37.

The suction pump 34 and the lift units 35 and 37 are controlled by a controller 38 (refer to FIG. 3). In other words, at the time of carrying out the purge operation when the ink cartridge has been replaced or when a periodic maintenance is carried out, the head holder 3 is moved to a position facing a suction mechanism 31. Thereafter, by driving the lift unit 35, the suction cap 32 is brought in a close contact with the nozzle surface of the ink-jet head 2, and by driving the suction pump 34 communicating with the suction cap 32 for a fixed time, the thickened ink and air inside the ink-jet head 2 are sucked and discharged to outside. Thereafter, by driving the lift unit 35, the suction cap 32 is separated away from the nozzle surface 41Aa, and by driving the lift unit 37, the wiper 33 is moved upwardly. By moving the head holder 3 toward the recording paper, the wiper 33 is brought in contact with the nozzle surface 41Aa, and the ink adhered to the nozzle surface 41Aa is removed by wiping.

Figure 4:
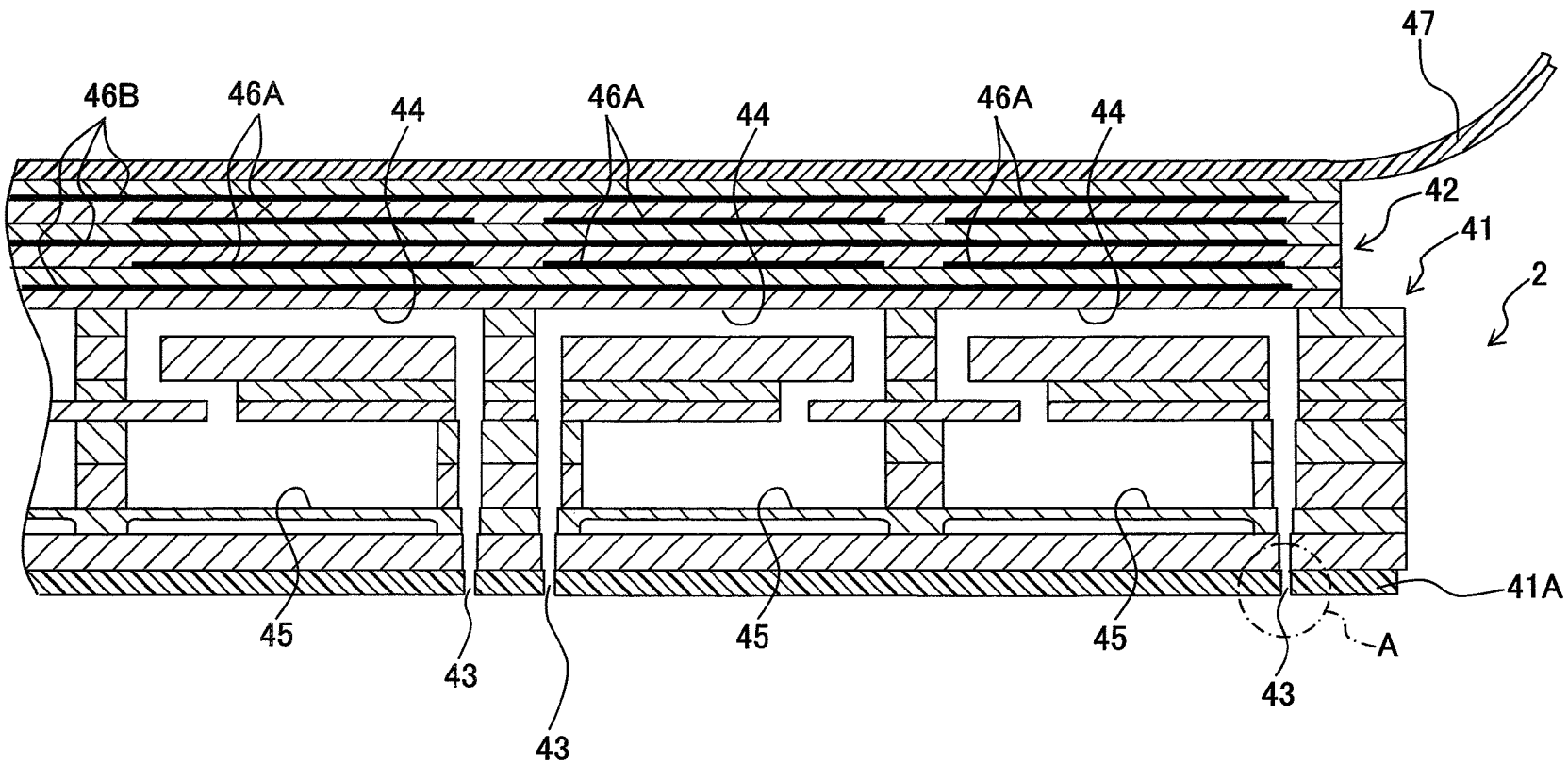
FIG. 4 is a cross-sectional view of the ink-jet head.

The ink-jet head 2, as shown in detail in FIG. 4, has a structure in which a piezoelectric actuator 42 is overlapped with a cavity unit 41. The cavity unit 41 is formed by stacking a plurality of plates including a nozzle plate 41A. Moreover, a plurality of pressure chambers 44 is arranged in a matrix form, and each of the pressure chambers 44 communicates with one of a plurality of nozzle holes 43, and common ink chambers 45 which supply the ink to rows of the pressure chambers 44 respectively are formed in the cavity unit 41. The ink is infused into each of the common ink chambers 45 from an ink supply port (not shown in the diagram) opening in the form of a row on an upper surface of the cavity unit 41. The ink is distributed from the common ink chambers 45 to the corresponding pressure chambers 44 respectively, and reaches the nozzle holes 43 from the pressure chambers 44. The piezoelectric actuator 42 includes a plurality of stacked ceramics sheets in the form of a flat plate. An individual electrode 46A corresponding to each pressure chamber 44, and a common electrode 46B which is common for all pressure chambers 44 are sandwiched alternately between the ceramics sheets. Portions of the ceramics sheets sandwiched by the individual electrodes 46A and the common electrode 46B are deformed due to a piezoelectric effect, and function as drive portions. These drive portions are arranged in plurality in the form of a plane corresponding to the pressure chambers 44. By driving one of the drive portions selectively, a jetting pressure is applied to the ink in the pressure chamber 44 corresponding to the drive portion, and the ink is jetted from the nozzle hole 43. Connecting terminals (not shown in the diagram), each electrically connected to one of the drive portions, are arranged in the form of a matrix in a plane form on an upper surface of the piezoelectric actuator 42, and a flexible circuit board 47 having a wiring pattern to be connected to the connecting terminals is fixed in parallel to the upper surface of the piezoelectric actuator 42.

Figure 5A:
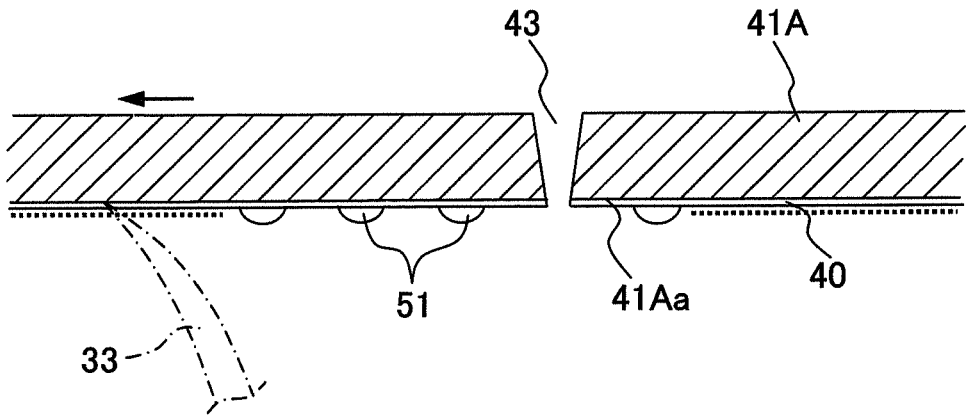
FIG. 5A is a partially enlarged view of FIG. 4.
Figure 5B:
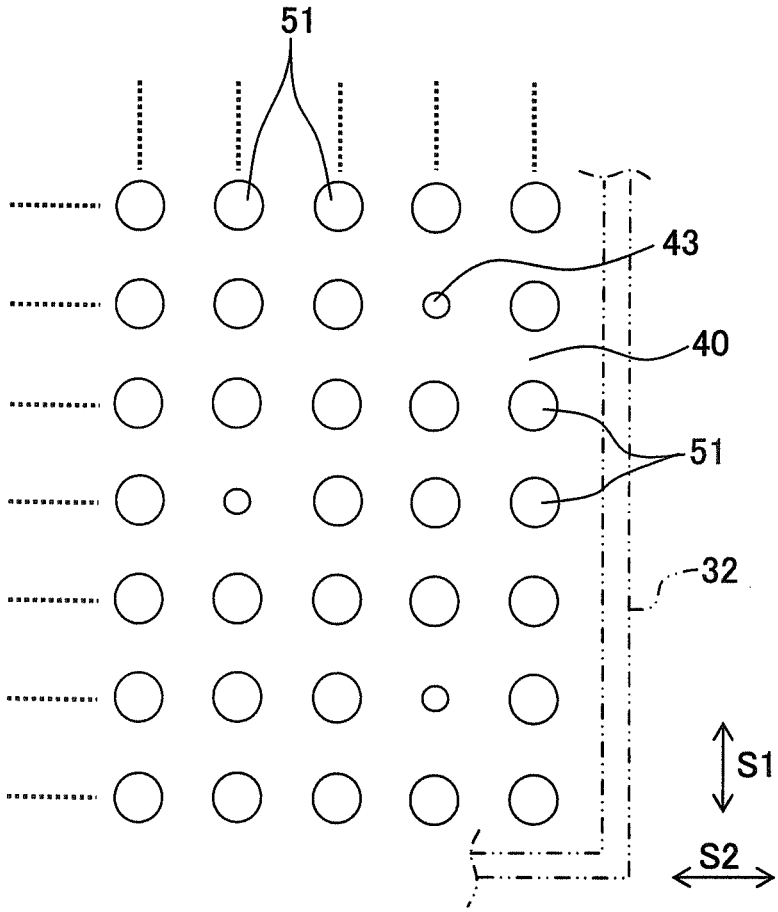
FIG. 5B is a partial bottom view of a nozzle surface.

As shown in enlarged forms in FIG. 5A and FIG. 5B, a plurality of projections 51 having a constant height is formed on the nozzle surface 41Aa of the nozzle plate 41A in which the nozzle holes 43 for jetting the ink are open. These projections 51 are arranged uniformly nearby, at least surrounding the nozzle holes 43, and it is preferable that the projections 51 are arranged orderly in a nozzle-row direction S1 and a direction S2 orthogonal to the nozzle rows. These projections 51 are formed to prevent the recording paper from making a direct contact with the nozzle surface 41Aa due to jamming of the recording paper (when the recording paper is jammed), and exhibit a function of avoiding a water repellent film 40 and the nozzle surface 41Aa from being damaged due to such contact.

Each of the projections 51 has a diameter (about 40 μm) larger than a diameter of the nozzle holes 43 which is about 20 μm, and is projected about 20 μm from the nozzle surface 41Aa, and is formed between the nozzle holes 43. Moreover, the projections 51, as shown in FIG. 5B, are formed orderly with a constant pitch (about 85 μm) in the nozzle-row direction S1 and a direction S2 which is orthogonal to the nozzle-row direction S1. Concretely, in each nozzle row, the projections 51 (3 projections 51 in an example shown in FIG. 5B) between the nozzle holes 43 are formed at the constant pitch along the nozzle-row direction S1. A row of the projections 51 in which the projections 51 are formed at the constant pitch is arranged between the nozzle rows extending in the nozzle-row direction S1.

As shown in FIG. 5B, the hollow suction cap 32 is detachably connected to the nozzle surface 41Aa of the nozzle plate 41A to cover the nozzle holes 43, and the projections 51 are formed at an inner side of a portion to which the suction cap 32 is connected. Since a portion of the nozzle surface 41Aa to which the suction cap 32 is connected is flat, the connection of the suction cap 32 is not hindered. Moreover, in order that the wiper 33 is capable of wiping the nozzle surface 41Aa without being hindered by the projections 51, it is preferable to form the wiper 33 to be flexible by making a front end thereof thin. Or it is preferable to form the projections 51 to be spherical-shaped such that outer peripheral surfaces do not rise steeply from the nozzle surface 41Aa.

Figure 6:
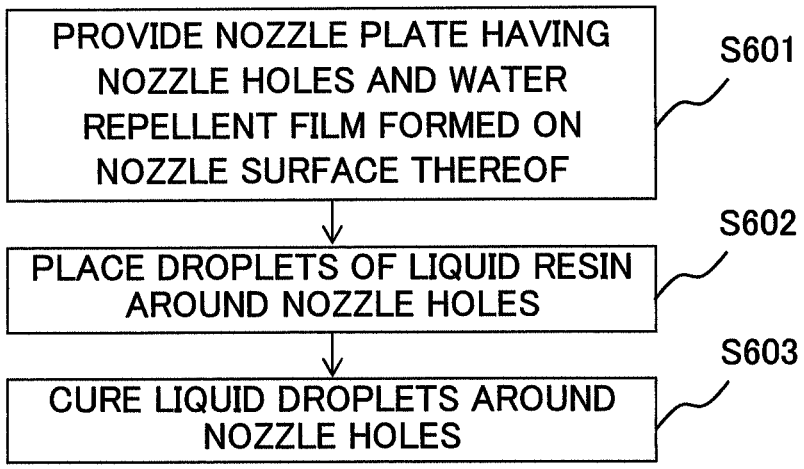
FIG. 6 is a flowchart showing a method for manufacturing a nozzle plate according to the embodiment.

Next, a method for forming the projections 51 on the nozzle surface 41Aa of the nozzle plate 41A will be described below by referring to FIG. 6.

Firstly, the nozzle plate 41A having a nozzle surface 41Aa in which the nozzle holes 43 are formed, and on which the water repellent film 40 is formed is provided (step S601). It is possible to form the nozzle holes 43 with a method such as an etching. Moreover, it is possible to form the water repellent film 40, by spraying fluororesin or by depositing fluororesin with a vapor-deposition method, on the nozzle surface 41Aa in which the nozzles 43 are formed. Furthermore, a plurality of droplets of a liquid resin is placed on the nozzle surface 41Aa, of a nozzle plate 41A, on which the water repellent film 40 is formed near an area surrounding the nozzle holes 43, such that the droplets have a mountain shape and a constant height (step S602). The liquid droplets are placed on the nozzle surface 41Aa using printing by jetting in the form of liquid droplets by using an ink-jet liquid jetting apparatus. As a liquid resin, it is possible to use an ultraviolet-cured resin which is cured by irradiation of ultraviolet rays.

When a resin such as an ultraviolet-curable resin is used as the liquid resin, by irradiating ultraviolet rays to cure the liquid droplets (step S603), the projections 51 of the constant height are formed near the nozzle hole 43.

Accordingly, it is possible to form easily the projections 51 near the nozzle holes 43 on the nozzle surface 41Aa of the nozzle plate 41A.

In addition to the embodiment described above, it is possible to make the following modifications in the present invention.

Figure 7:
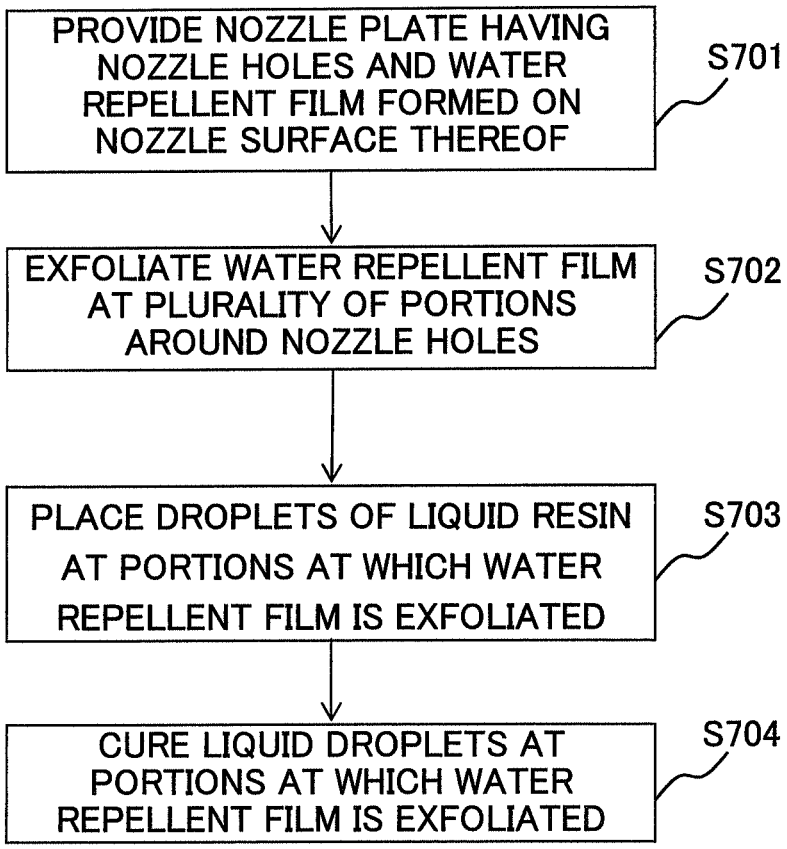
FIG. 7 is a flowchart showing a method for manufacturing a nozzle plate according to a modified embodiment.
Figure 9:
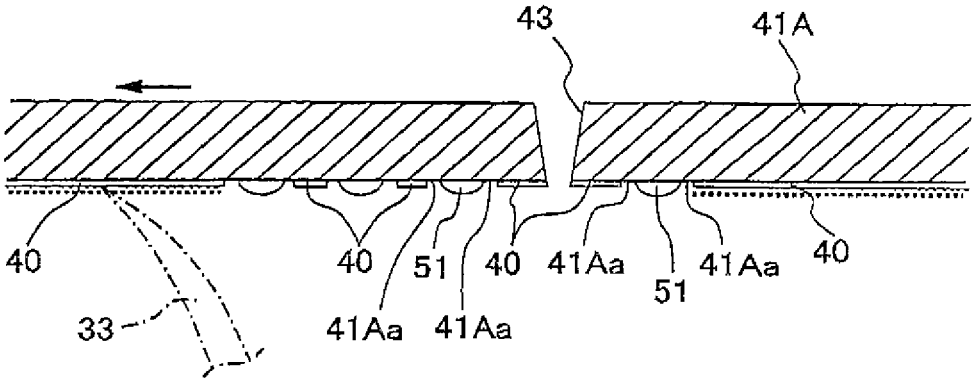
FIG. 9 is similar to FIG. 5A, but shows an embodiment where the water-repellent film is exfoliated.

Before placing the liquid droplets of the liquid resin, the water repellent film 40 may be exfoliated in advance at portions where the liquid droplets are to be placed. As shown in FIG. 7, firstly, the nozzle plate 41A is provided (step S701). The nozzle plate has the nozzle surface 41Aa in which the nozzle holes 43 are formed, and on which the water repellent film 40 is formed. Next, the water repellent film 40 at a plurality of portions around each nozzle hole 43 in the nozzle surface 41Aa on which the water repellent film 40 is formed is exfoliated by laser or the like (step S702). Thereafter, the liquid droplets of a liquid resin are placed on the portions at which the water repellent film 40 has been exfoliated (step S703), and by curing the liquid droplets (step S704), the projections 51 of the constant height are formed around the nozzle holes 43. Accordingly, since it is possible to form the projections 51 on the nozzle surface 41Aa without the water repellent film 40 intervening therebetween, as shown in FIG. 9, it is possible to improve adhesiveness between the nozzle surface 41A and the projections 51.

Figure 8:
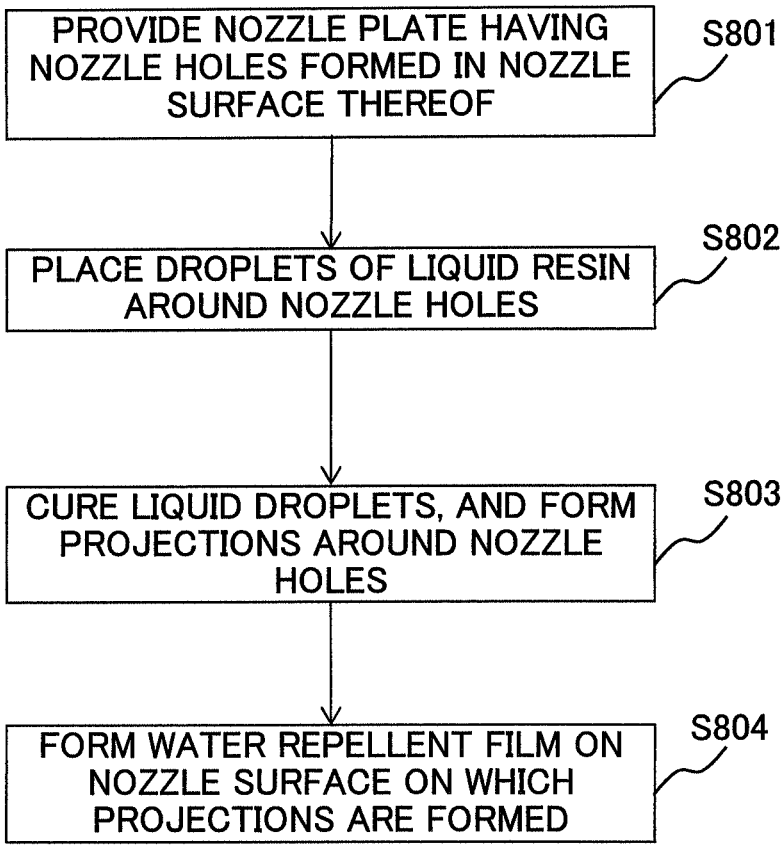
FIG. 8 is a flowchart showing a method for manufacturing a nozzle plate according to another modified embodiment.

Moreover, for improving the adhesiveness similarly, as shown in FIG. 8, the nozzle plate 41A having the nozzle surface 41Aa in which the plurality of nozzle holes 43 is formed may be provided (step S801). Next, the plurality of droplets of a liquid resin may be placed around the nozzle holes 43 of the nozzle surface 41Aa before forming the water repellent film 40 (step S802). By curing the liquid droplets, the projections 51 of constant height may be formed (step S803). In this case, the water repellent film 40 is formed on the nozzle surface 41Aa after the projections 51 are formed around the nozzle hole 43 (step S804). In this case, it is possible to form the water repellent film 40 by a method similar to the method used in the embodiment.

In the embodiment described above, each of the projections 51 has a mountain shape in the cross-sectional view. However, the present invention is not restricted to the mountain shape. Each of the projections 51 may have a shape which hardly allows the recording paper to make a direct contact with the water repellent film 40 of the nozzle surface 41Aa. Further, each of the projections 51 may not have the same shape and size.

In the embodiment described above, a case in which the liquid droplet jetting apparatus is an ink-jet recording apparatus has been described. However, the present invention is not restricted to this case, and it is also applicable to other liquid droplet jetting apparatuses which apply fine droplets of a coloring liquid, or which form a wiring pattern by jetting an electroconductive liquid.

In the embodiment described above, the drive portions for jetting the ink (liquid) are piezoelectric type. However, it is also possible to use drive portions which carry out a jetting operation by an electrostatic force or by an electric heating element.

In the embodiment described above, the recording medium is a recording paper. However, it is possible to use various recording media such as a resin and a cloth, and as a liquid to be jetted, it is possible to use not only an ink but various liquids such as a coloring liquid or a functional liquid.

What is claimed is:

1. A method for manufacturing a nozzle plate, comprising:

providing a substrate having a nozzle surface in which a plurality of nozzle holes for jetting a liquid has been formed, the nozzle surface having a water repellent film formed thereon;

placing a plurality of droplets of a liquid resin around each of the nozzle holes;

curing the liquid droplets to form projections of a constant height around the nozzle holes; and exfoliating the water repellent film from the nozzle surface at a plurality of portions around each of the nozzle holes without penetrating the substrate before placing the plurality of droplets of a liquid resin around each of the nozzle holes;

wherein the plurality of droplets of a liquid resin are placed on the portions at which the water repellent film is exfoliated.

2. The method for manufacturing the nozzle plate according to claim 1;

wherein a hollow suction cap is detachably connected to the nozzle surface of the substrate, to cover the nozzle holes, and the projections are formed on the nozzle plate at a portion different from a portion to which the suction cap is connected.

3. The method for manufacturing the nozzle plate according to claim 2;

wherein the projections are provided between the nozzle holes, and the projections and the nozzle holes are formed orderly in a predetermined direction and a direction orthogonal to the predetermined direction.

4. The method for manufacturing the nozzle plate according to claim 1;

wherein the liquid droplets are placed by jetting the liquid resin in a form of liquid droplets to print the liquid droplets on the nozzle surface.

5. The method for manufacturing the nozzle plate according to claim 4;

wherein the liquid resin is an ultraviolet-curable resin, and is cured by irradiation of ultraviolet ray.

* * * * *